US010807839B2

(12) United States Patent
Fanello et al.

(10) Patent No.: US 10,807,839 B2
(45) Date of Patent: Oct. 20, 2020

(54) PIPELAYER MACHINE HAVING HOISTING SYSTEM WITH PIVOTABLE FAIRLEAD

(71) Applicant: Caterpillar Inc., Deerfield, IL (US)

(72) Inventors: Shawn Philip Fanello, Chillicothe, IL (US); Timothy Edward Camacho, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 271 days.

(21) Appl. No.: 15/973,066

(22) Filed: May 7, 2018

(65) Prior Publication Data

US 2019/0337776 A1 Nov. 7, 2019

(51) Int. Cl.

| | |
|---|---|
| ***B66C 23/62*** | (2006.01) |
| ***B66C 1/36*** | (2006.01) |
| ***B66C 23/44*** | (2006.01) |
| ***B66D 1/00*** | (2006.01) |
| ***B66D 1/54*** | (2006.01) |
| ***B66C 15/06*** | (2006.01) |
| ***B66D 1/48*** | (2006.01) |
| ***B66D 1/36*** | (2006.01) |

(52) U.S. Cl.

CPC ..... *B66C 23/62* (2013.01); *B66C 15/065* (2013.01); *B66C 23/44* (2013.01); *B66D 1/00* (2013.01); *B66D 1/36* (2013.01); *B66D 1/48* (2013.01); *B66D 1/54* (2013.01); *B66C 2700/0357* (2013.01); *B66D 2700/0191* (2013.01)

(58) Field of Classification Search

CPC ..... B66C 23/00; B66C 23/06; B66C 23/36; B66C 23/44; B66C 23/90; B66C 23/905; B66C 15/06; B66C 15/065; B66C 13/00; B66C 13/16; B66C 13/18; B66C 13/22; B66C 9/00; B66C 23/62; B66D 1/36; B66D 1/00; B66D 1/48; B66D 1/54

See application file for complete search history.

(56) References Cited

U.S. PATENT DOCUMENTS 2,022,844 A * 12/1935 Christian ..... B66C 23/90 212/283
2,425,663 A * 8/1947 Wooldridge ..... B66C 23/36 212/288
2,722,320 A * 11/1955 Carlson ..... B66C 23/76 212/196
3,005,559 A * 10/1961 Toderick ..... B66C 23/72 212/280

(Continued)

OTHER PUBLICATIONS

Alexander Katrycz, World Premiere At Conexpo 2017: Liebherr Launches the High Performance Pipelayer RL 56, press release, Mar. 7, 2017, Las Vegas, NV.

*Primary Examiner* — Michael R Mansen
*Assistant Examiner* — Juan J Campos, Jr.
(74) *Attorney, Agent, or Firm* — Jonathan F. Yates; William R. Tinker

(57) ABSTRACT

A machine includes a frame, ground-engaging elements coupled to the frame, and a hoisting system having a sideboom and a fairlead. The hoisting system also includes a hook pulley block and a hoisting cable extending through the fairlead and the hook pulley block and held in tension such that the hoisting cable couples pivoting of the fairlead to pivoting of the sideboom. The pivotable fairlead may be instrumented with position, cable loading, and cable feed sensors.

15 Claims, 5 Drawing Sheets

(56) References Cited

U.S. PATENT DOCUMENTS 3,055,511 A * 9/1962 Sharp ..... B66C 23/44 212/258
3,058,600 A * 10/1962 Gosnell ..... B66C 23/44 212/203
3,265,220 A * 8/1966 Knight ..... B66C 23/90 212/278
3,269,560 A * 8/1966 Knight ..... B66C 23/905 212/278
3,278,925 A * 10/1966 Saunders ..... G08B 5/02 340/522
3,329,283 A * 7/1967 Wade ..... B66C 23/44 212/300
3,357,571 A * 12/1967 Boughton ..... B66C 23/90 212/277
3,426,915 A * 2/1969 Tesch ..... B66C 23/44 212/300
3,479,984 A * 11/1969 Deluca, Jr. ..... B66C 23/90 33/370
3,708,152 A * 1/1973 Bulin ..... B66D 1/36 254/327
3,815,478 A * 6/1974 Axelsson ..... B66D 1/08 91/497
3,912,230 A * 10/1975 Learmont ..... B66D 1/36 254/336
4,132,317 A * 1/1979 Arendt ..... B66C 23/76 180/9.48
4,143,856 A * 3/1979 Morrow, Sr. ..... E02F 3/48 192/3.25
4,172,688 A * 10/1979 Cecchi ..... B66C 23/90 116/284
5,332,110 A * 7/1994 Forsyth ..... B66C 23/44 212/196
5,392,936 A 2/1995 Solomon et al.
5,992,655 A * 11/1999 Greenberg ..... B66C 23/44 212/258
6,000,563 A * 12/1999 Greenberg ..... B66C 23/44 212/258
8,152,412 B2 4/2012 Davis
8,662,816 B2 3/2014 Grimes et al.
2004/0033109 A1* 2/2004 Gelmi ..... B66C 23/44 405/174
2004/0190995 A1* 9/2004 Matsushita ..... F16L 1/036 405/174
2006/0245888 A1* 11/2006 Dietz ..... B66C 23/44 414/563
2009/0297275 A1* 12/2009 Davis ..... F16L 1/028 405/174
2016/0060082 A1* 3/2016 Huang ..... B66D 1/44 700/213
2016/0207744 A1* 7/2016 Uemura ..... B66D 1/36
2019/0023538 A1* 1/2019 Pletz ..... B66C 23/42
2019/0033158 A1* 1/2019 Bonnet ..... G01M 1/14

* cited by examiner

PIPELAYER MACHINE HAVING HOISTING SYSTEM WITH PIVOTABLE FAIRLEAD

TECHNICAL FIELD

The present disclosure relates generally to a machine equipped with a sideboom and fairlead for guiding a hoisting cable to and from the sideboom, and more particularly to such a machine where the fairlead is pivotable.

BACKGROUND

Pipelayers are specialized machines used to suspend and place pipelines in a prepared trench or the like. A typical pipelayer includes a load manipulating boom that projects outwardly from the side of the machine in a direction generally perpendicular to a forward travel direction. It is common for a cable and rigging system to be provided for manipulating the position of the boom, as well as a load suspended by the boom adjacent to or within a trench. It is also typical for pipelayers to operate in teams with a group of the machines operating in a coordinated fashion, to each support a different section of pipe as the pipe is gradually placed into a trench. In some instances the pipe sections are welded together as they are suspended by the pipelayer machines. Pipelayer teams often require precise and concerted efforts not only for successful placement but also to optimize speed and efficiency and protect operators and ground crew personnel.

Due to the nature of pipeline placement and support of pipe sections out to the side of the machine, there can be challenges to stably supporting the suspended load without risking tipping the machine. These challenges can be particularly acute in poor underfoot conditions, as well as steep terrain. To enhance stability most pipelayer machines are equipped with a counterweight positioned opposite the sideboom, and which can be adjusted to compensate for adjustments in the height and positioning of a suspended load. One example pipelayer machine is known from U.S. Pat. No. 8,783,477 to Camacho et al. It will be appreciated that a significant degree of operator skill can be required to control the speed and travel direction of a pipelayer machine while also monitoring and adjusting the suspension height of the load and positioning of the supporting sideboom. The availability of skilled operators, as well as ground crew, at worksites that are often remote has long challenged the industry. For these and other reasons, continued advancements and improvements to develop and exploit technological solutions in the pipelayer field are desirable.

SUMMARY OF THE INVENTION

In one aspect, a fairlead for a hoisting system in a ground-engaging machine includes a fairlead base for coupling to a frame of the ground-engaging machine, a fairlead boom, and a pivot joint pivotably coupling the fairlead boom to the fairlead base. The fairlead further includes a plurality of feed pullies mounted to the fairlead boom for feeding a hoisting cable through the fairlead between a winch assembly and a sideboom in the ground-engaging machine. The fairlead further includes instrumentation circuitry including a wiring harness structured for electrically connecting to hoisting control circuitry onboard the ground-engaging machine.

In another aspect, a hoisting system for a ground-engaging machine includes a winch assembly, a sideboom, and a fairlead for feeding a hoisting cable between the winch assembly and the sideboom. The fairlead includes a fairlead base structured for coupling to a frame of the ground-engaging machine, a fairlead boom, and a pivot joint pivotably coupling the fairlead boom to the fairlead base. The hoisting system further includes a control system having instrumentation circuitry resident on the fairlead and including a wiring harness for electrically connecting to hoisting control circuitry onboard the ground-engaging machine.

In still another aspect, a method of operating a ground-engaging machine includes producing a fairlead monitoring signal indicative of an orientation of a fairlead in a hoisting system of the ground-engaging machine. The fairlead is supported upon a frame of the ground-engaging machine and pivotable about a fairlead pivot axis relative to the frame. The method further includes producing a load monitoring signal indicative of a load on a hoisting cable guided by the fairlead to and from a sideboom pivotable about a sideboom pivot axis relative to the frame, and outputting an overload alert based on the frame monitoring signal and the load monitoring signal.

In still another aspect, a machine includes a frame having a front frame end and a back frame end, and ground-engaging elements coupled to the frame. The machine further includes an operator station coupled to the frame, and a hoisting system including a sideboom, a winch assembly, and a fairlead, coupled to the frame. The sideboom is pivotable about a sideboom pivot axis to vary an orientation of the sideboom between a raised sideboom position, and a lowered sideboom position at which the sideboom extends outboard of the frame. The fairlead is supported upon the frame at a fairlead mounting location that is longitudinally between the front frame end and the back frame end and latitudinally between the sideboom and the winch assembly. The fairlead is pivotable about a fairlead pivot axis so as to position the fairlead at a range of orientations for feeding a hoisting cable between the winch assembly and the sideboom.

In still another aspect, a fairlead for a ground-engaging machine includes a fairlead base structured for coupling to a frame of the ground-engaging machine. The fairlead further includes a fairlead boom having a first boom end and a second boom end, and a through-channel extending between an inboard boom side and an outboard boom side at a location between the first boom end and the second boom end. The fairlead further includes a pivot joint pivotably coupling the fairlead boom to the fairlead base and defining a fairlead pivot axis. The fairlead further includes a first feed pulley and a second feed pulley each mounted to the fairlead boom and positioned at least partially within the through-channel, and being arranged so as to feed a hoisting cable passed between the first feed pulley and the second feed pulley between a winch assembly and a sideboom in the machine.

DETAILED DESCRIPTION

Figure 1:
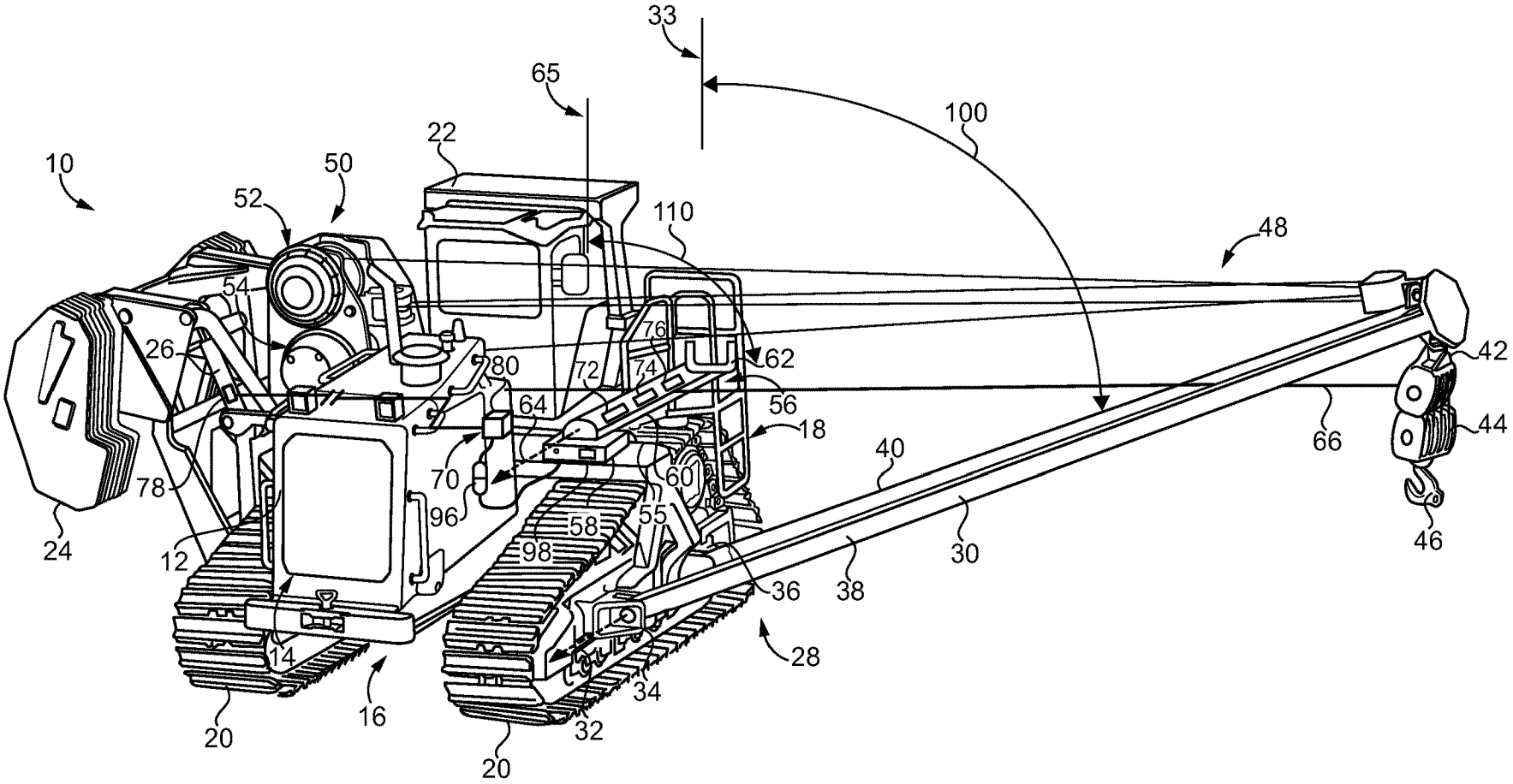
FIG. 1 is a diagrammatic view of a machine, according to one embodiment.

Referring to FIG. 1, there is shown a ground-engaging machine 10 according to one embodiment, and structured as a pipelayer machine for transporting, suspending, and placing pipe sections of a pipeline according to generally known practices. Machine 10 includes a frame 12 having a front frame end 16 and a back frame end 18. An engine system 14 is mounted adjacent to front frame end 16 in the illustrated embodiment. An operator station 22 is coupled to and mounted upon frame 12 between front frame end 16 and back frame end 18. Operator station 22 can include an operator cab. Ground-engaging elements 20, including tracks in the illustrated embodiment, are coupled to and positioned upon opposite sides of frame 12. Machine 10 further includes a counterweight 24 positioned upon one side of frame 12 and adjustable by way of one or more counterweight actuators 26 in a generally conventional manner.

Machine 10 also includes a hoisting system 28 having a sideboom 30 movable by pivoting relative to frame 12 about a sideboom pivot axis 32. Sideboom 30 may be pivotable between a raised or stowed position, at which sideboom 30 may be generally aligned with a vertical line 33, and a second sideboom position at which sideboom 30 extends outboard of frame 12. The second sideboom position could be approximately as illustrated in FIG. 1, however, sideboom 30 may be structured for lowering further than what is shown in FIG. 1, below a horizontal plane in certain embodiments. An example sideboom pivoting range is shown at 100. Those skilled in the art will be familiar with positioning and adjustment of a counterweight such as counterweight 24 to offset a load supported by way of sideboom 30, such as a length of pipe. In an implementation, sideboom 30 may be coupled to frame 12 at each of a forward-mounting location and a rearward-mounting location by way of a forward connector 34 and a rearward connector 36. Sideboom 30 may further include a first or forward beam 38 and a second or rearward beam 40 that extend from connectors 34 and 36 in a generally triangular pattern. Other sideboom designs and configurations could be employed in different embodiments.

Hoisting system 28 further includes an upper hook pulley block 42 supported by sideboom 30, and a hoisting cable 66. A lower hook pulley block 44 is suspended by way of hoisting cable 66 from upper hook pulley block 42 and includes a hook 46 for suspending a load, such as a pipe section within a roller sling or the like. One or more boom cables 48 extend between sideboom 30 and a winch assembly or system 50. Winch system 50 can include a first winch 52 including a winding drum or the like not visible in FIG. 1, and a second winch 54 including a second winding drum or the like also not visible in FIG. 1. Hoisting cable 66 may be attached to and wound about the drum of second winch 54, whereas one or more of cables 48 can be attached to and wound about the drum of first winch 52.

Hoisting system 28 also includes a fairlead 56 movable by pivoting relative to frame 12 about a fairlead pivot axis 64. Sideboom pivot axis 32 and fairlead pivot axis 64 have fixed orientations relative to frame 12 and extend in parallel with one another in a fore-to-aft direction. Fairlead 56 can include a fairlead base 58 and a fairlead boom 60 supported upon fairlead base 58. Fairlead base 58 may be supported upon and coupled to frame 12 at a third location, or fairlead mounting location, that is longitudinally between front frame end 16 and back frame end 18, and latitudinally between sideboom 30 and winch system 50. The fairlead mounting location can also be vertically higher than and inboard of the forward location of connector 34 and the rearward location of connector 36, and between the forward location and the rearward location in a longitudinal or fore-to-aft direction. The fairlead mounting location can also be forward of operator station 22, and outboard of operator station 22. Fairlead 56 may be mounted, such as by bolting or welding, to a centerframe beam 55, or to frame 12 directly. Fairlead 56 may also include a cable guide 62 in the nature of a bar having upturned ends to form, generally, a U-shape, for receiving and locating boom cables 48 when sideboom 30 is lowered. Hoisting cable 66 extends through each of fairlead 56 and upper hook pulley block 42. The weight of hook pulley block 44, as well as any load also suspended by hook 46, holds hoisting cable 66 in tension such that hoisting cable 66 couples the pivoting of fairlead 56 to the pivoting of sideboom 30. Fairlead 56 might be pivoted about pivot axis 64 from the orientation shown in FIG. 1 to a raised or stowed position aligned with a vertical line 65, or to a lowered position. Pivoting of fairlead 56 positions fairlead 56 at any of a range of orientations, relative to frame 12 and to an underlying substrate, for feeding hoisting cable 66 between winch system 50 and sideboom 30. Pivoting of fairlead 56 defines a fairlead pivot range 110. Pivoting of sideboom 30 defines sideboom pivot range 100 as noted above. Fairlead pivot range 110 may be smaller than pivot range 100. Pivoting of fairlead 56, and in particular lowering of fairlead 56 as sideboom 30 is lowered to place a pipe section in a trench, can improve an operator or ground crew field of view, and in particular operator line of sight to hook 46, from what would typically be observed where a traditional, non-pivoting fairlead is used. An operator field of view from operator station 22 to an underlying substrate, such as a left-forward quadrant of an operator field of view, may thus be obstructed to a relatively greater extent when fairlead 56 is raised, and to a relatively lesser extent when fairlead 56 is lowered. It can therefore be appreciated that as sideboom 30 is lowered, potential obstruction of the field of view by fairlead 56 can be reduced, a feature contemplated to provide advantages during operating machine 10.

Hoisting system 28 further includes a control system 70. Control system 70 includes a fairlead sensor 72 structured to produce a fairlead monitoring signal indicative of an orientation of fairlead 56. Control system 70 further includes a load sensor 74 structured to produce a load monitoring signal indicative of a load on hoisting cable 66. In one embodiment each of fairlead sensor 72 and load sensor 74 is resident on fairlead 56. Control system 70 also includes a cable feed sensor 76 structured to produce a cable feeding signal indicative of a length of hoisting cable 66 fed through fairlead 56. Cable feed sensor 76 may also be resident on fairlead 56. A counterweight sensor 78 is associated with counterweight 24 and structured to produce a counterweight monitoring signal indicative of an orientation of counterweight 24 relative to frame 12. It should be appreciated that a position of any one of the pivotable components of interest discussed herein can be indicative of an orientation, and vice versa such that the terms position and orientation are used interchangeably. Accordingly, rotary potentiometers, linear potentiometers, Hall effect sensors, inductive sensors, capacitive sensors, mechanical switches, and still others can be employed to directly, indirectly, or inferentially indicate relative positions and orientations of components of machine 10, the significance of which will be further apparent from the following description. A frame sensor is shown at 98 and produces a frame monitoring signal indicative of an orientation of frame 12 relative to an underlying substrate. Sensors 72, 74, and 76 may be part of instrumentation circuitry, further discussed herein and shown at reference numeral 71 in FIG. 3, that is part of and resident on fairlead 56. Sensor 78, and potentially other sensors, may be part of hoisting control circuitry, also further discussed herein and shown at reference numeral 79 in FIG. 3, that is onboard machine 10. Hoisting control circuitry 79 can also include or be coupled with one or more computers and operator input and control devices, as explained below. A wiring harness 96 may be part of instrumentation circuitry 71 and structured to electrically connect instrumentation circuitry 71 to hoisting control circuitry 79, as further discussed herein.

Figure 2:
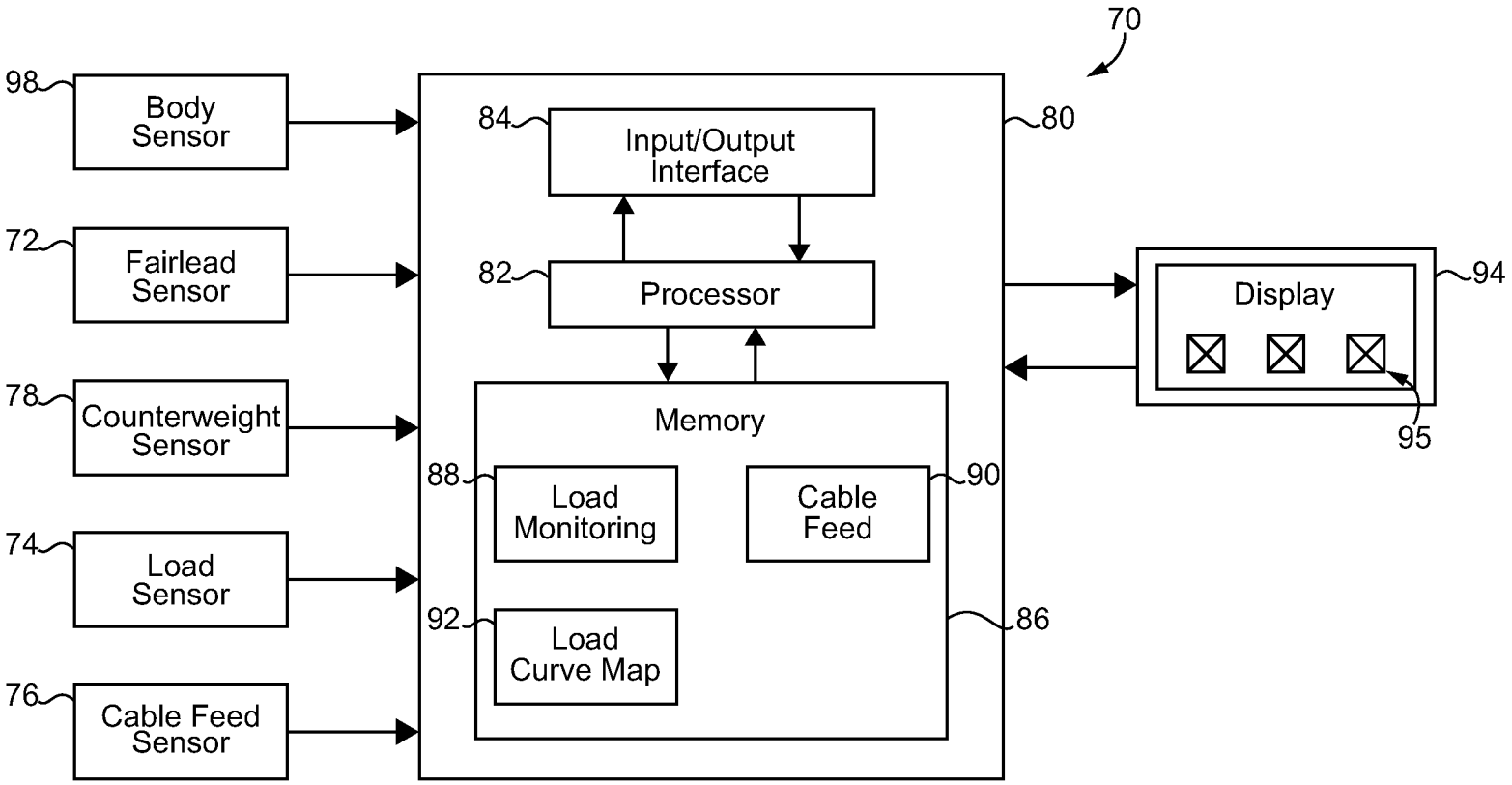
FIG. 2 is a block diagram of a control system suitable for use in the machine of FIG. 1.

Referring also now to FIG. 2, there are shown components of control system 70 in an example arrangement. Control system 70 also includes an electronic control unit 80 having an input/output interface 84, for receiving inputs from various sensors and sending outputs in the nature of control commands, monitored quantities or qualities, and condition alerts as further discussed herein. Electronic control unit 80 further includes a processor 82, which can include any suitable central processing unit such as a microcontroller or a microprocessor. Processor 82 is in communication with a memory 86 that stores computer executable program instructions in the nature of a load monitoring program or control routine 88 and a cable feed program or control routine 90, as also further discussed herein. Memory 86 can include RAM, ROM, a hard drive, Flash, SDRAM, EEPROM, or still another type of memory. A load curve map is shown at 92 and is referenced by load monitoring routine 88 to determine a load condition of machine 10, such as an overload condition or likely overload condition, and generate appropriate alerts, as further discussed herein. A display 94, which may be mounted in or on operator station 22, can include a graphical user interface such as a touchscreen (not numbered), structured to convey various types of information to an operator, and receive control inputs from an operator. A plurality of icons are shown at 95 and represent alerts or warnings that can be presented to an operator by way of illumination, for example. Other operator perceptible alerts such as audible alerts might be used.

In a practical implementation strategy, some or all of the components of control system 70 can be provided on or in fairlead 56. As noted above, each of sensors 72, 74, and 76 can be resident on fairlead 56, in particular resident on fairlead boom 60. Frame sensor 98 may be resident on fairlead base 58. Wiring harness 96 extends between fairlead 56 and electronic control unit 80, which can include a machine control unit structured for monitoring and controlling various aspects and functions of machine 10, or a dedicated electronic control unit for controlling and/or monitoring hoisting system 28. As also noted above, certain known pipelayers include non-pivoting fairleads. It is contemplated that fairlead 56 can be swapped for existing fairleads on pipelayers already in the field. In this general manner, some or all of the instrumentation for a hoisting system can be provided onboard an aftermarket fairlead installed in place of an existing fairlead. Certain earlier attempts at sideboom monitoring provided instrumentation on or associated with a pipelayer sideboom. A sideboom of a pipelayer is often removed for transport, requiring electrical connections for sideboom sensors and the like to be broken and reestablished, if at all, when a sideboom is removed and then reinstalled for use at another worksite. A hoisting system including a fairlead according to the present disclosure has instrumentation that can remain onboard, and connections that are not disrupted by way of usual disassembly of the pipelayer machine for transport or servicing.

Figure 3:
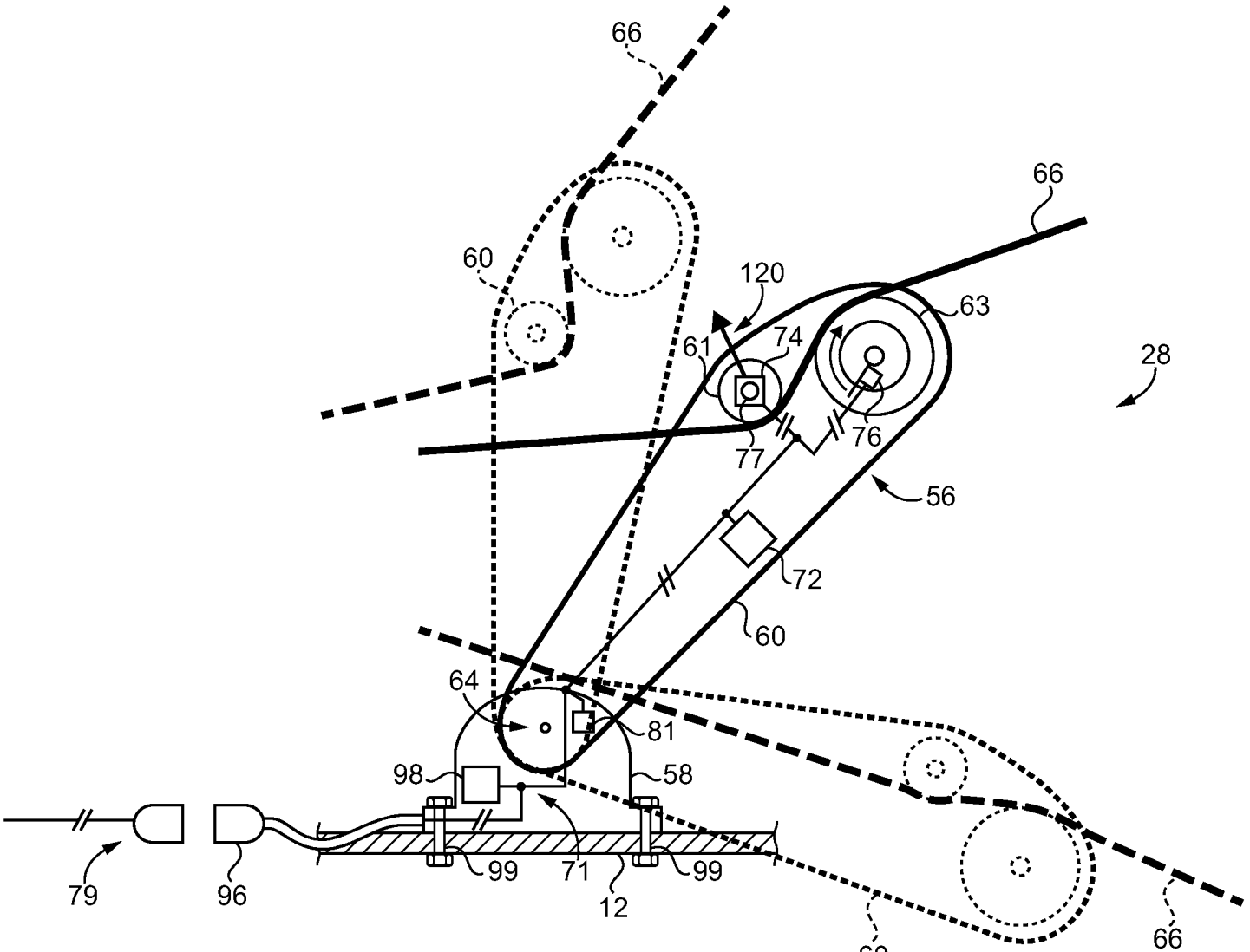
FIG. 3 is a diagrammatic view of parts of a hoisting system, according to one embodiment.

Referring also now to FIG. 3, there is shown a view of parts of hoisting system 28 in further detail, and showing fairlead base 58 as it might appear installed upon and mounted to frame 12 (or centerframe beam 55) by way of a plurality of bolts 99. Instrumentation circuitry 71 is resident on fairlead 56. Wiring harness 96 and/or an associated plug (not numbered) can electrically connect instrumentation circuitry to hoisting control circuitry 79. It should be appreciated that the term circuitry as used herein contemplates not only electrical wiring and the like but also circuit elements and electrical components such as sensors, plugs, switches, capacitors, inductors, filters, transistors, and still others. Accordingly, wiring alone is not fairly considered instrumentation circuitry or control circuitry in the present context. In one embodiment, fairlead 56 can be installed in place of an existing fairlead and exploit the same bolting pattern that was used for the existing fairlead. Also shown in phantom in FIG. 3 is fairlead 56, and in particular boom 60 as it might appear raised and lowered. Hoisting cable 66 can be seen to extend through fairlead 56, in contact with and between a plurality of feed pulleys including a first feed pulley 61 and a second feed pulley 63 that guide hoisting cable 66 through fairlead 56. It will be recalled that load sensor 74 may be resident on fairlead 56, and in a practical implementation strategy includes a strain gauge coupled with a pulley pin 77 of first feed pulley 61. A force vector 120 is depicted in FIG. 3, and represents an example force exerted by tensioned hoisting cable 66 on first feed pulley 61. The contact between hoisting cable 66 and first feed pulley 61, and strain on pulley pin 77 enables load sensor 74 to produce the load monitoring signal that is indicative of a load on hoisting cable 66. Because the load or tension on hoisting cable 66 can vary with an orientation of fairlead 56, electronic control unit 80 can be structured to determine the actual current load or hook load based upon both the observed load on hoisting cable 66 as indicated by the raw load monitoring signal, and the orientation of fairlead 56, in turn indicative of an orientation of sideboom 30 that is suspending the hook load. As an alternative to a strain gauge, a different type of load sensor might be used such as a position sensor coupled with a displaceable mechanism such as a gas spring, a mechanical spring, or an otherwise deformable or deflectable mechanism.

It will also be recalled that cable feed sensor 76 produces a cable feeding signal indicative of a length of hoisting cable 66 fed through fairlead 56. In one embodiment cable feed sensor 76 can be structured to output the cable feeding signal each time feed pulley 63 completes a rotation in a first direction. Sensor 76, or another sensor (not shown), could output a cable infeed signal each time pulley 63 completes a rotation in an opposite direction. Still other strategies could be used, such as an arrangement of sensor targets on pulley 63 that are sensed to indicate rotation in one direction by way of a first pattern rotated past a sensor and indicate rotation in an opposite direction by way of a reverse pattern rotated past the sensor. Those skilled in the art will be familiar with the phenomenon of pulley block collision, and its potential risks of straining a hoisting cable or causing other problems. Electronic control unit 80 may be structured to output a pulley block collision alert based on the cable feeding signal. The pulley block collision alert can be based also upon the orientation of fairlead 56, since a length of cable fed through fairlead 56 can vary based upon varying orientation of fairlead 56. In other words, with fairlead 56 raised versus lowered different lengths of fed-out or fed-in cable will be associated with pulley block collision risk. A location of the normally stationary upper hook block 42 in space can be determined on the basis of fixed boom geometry and boom angle, which is directly proportional to fairlead angle/orientation. A location of lower hook block 44 can be determined on the basis of a length of cable fed through fairlead 56, with a number of pulley revolutions in a feeding out direction being proportional to cable length. Also shown in FIG. 3 is a sensor 81 that can be used in place of fairlead sensor 72 or as a supplement to fairlead sensor 72. Sensor 81 could be a rotary sensor structured to produce the fairlead monitoring signal responsive to an angular orientation of fairlead 56 about fairlead pivot axis 64. Each of fairlead sensor 72 and frame sensor 98 can include an inertial measurement unit or IMU in some embodiments. Electronic control unit 80 can receive the fairlead monitoring signal from fairlead sensor 72 (or from sensor 81), and the frame monitoring signal from sensor 98, to determine an orientation of fairlead 56, and based upon the known relationship between fairlead orientation and sideboom orientation, determine an angle of sideboom 30 relative to a horizontal reference plane or some other reference. In this general manner, electronic control unit 80 monitors orientation of fairlead 56 and can account for positioning of machine 10 upon a slope, and thus determine whether there is a risk of tipping over of machine 10 when supporting a given load. If it is determined, based on the fairlead monitoring signal and the load monitoring signal, that an unacceptable risk of tipping exists, or for another reason machine stability is compromised or likely to be compromised, electronic control unit 80 can output an overload alert to indicate to an operator that a limit has been reached or that corrective action needs to be taken, as further discussed herein.

Figure 5:
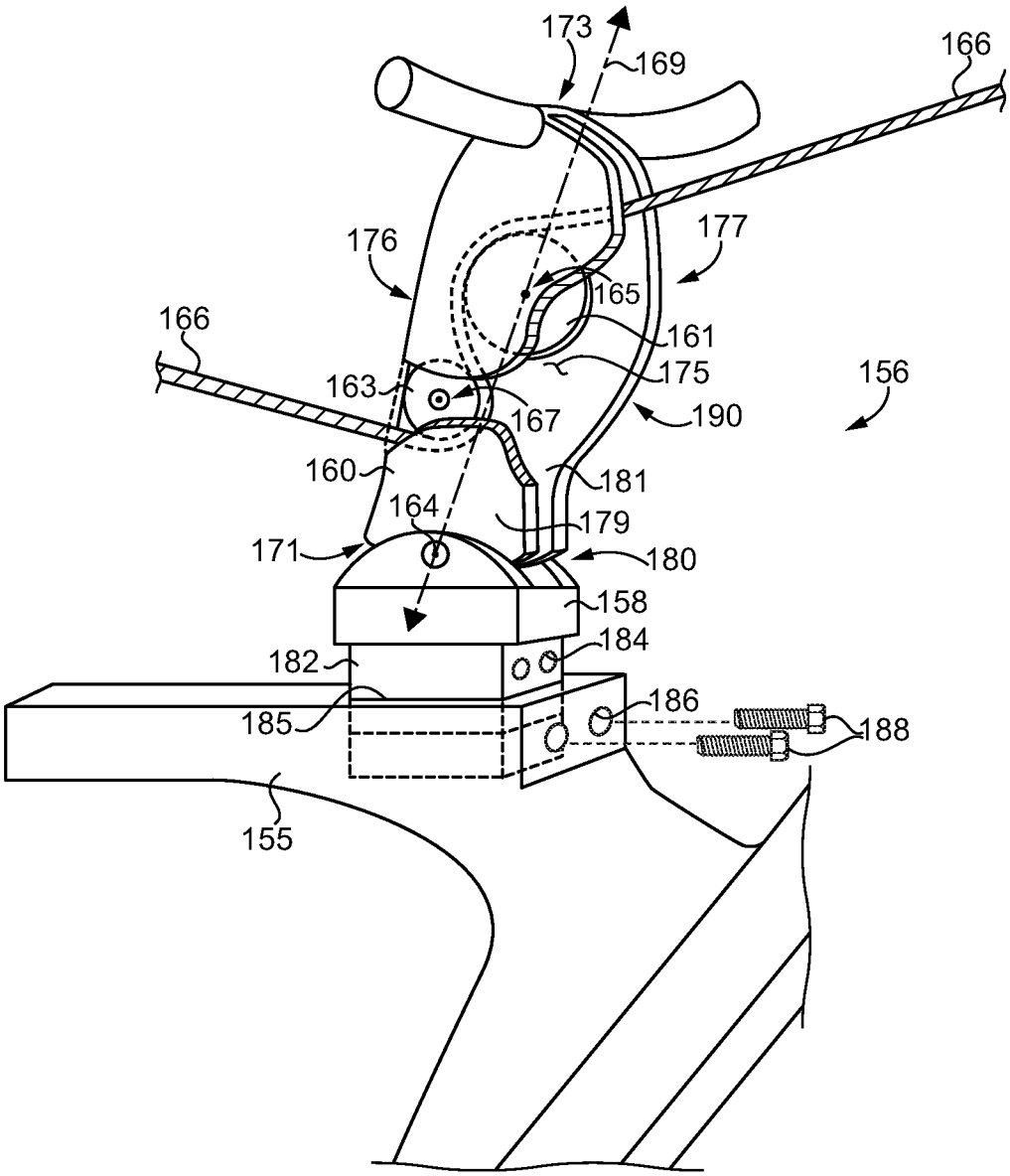
FIG. 5 is a partially open side diagrammatic view of a pivoting fairlead shown as it might appear ready for installation on a centerframe beam of a machine, according to one embodiment.

Referring to FIG. 5, there is shown a fairlead 156 which may be similar to or identical to the fairlead embodiments discussed above, and illustrating further details and features thereof. It will thus be appreciated that the following description of the embodiment of FIG. 5 can be understood by way of analogy to refer to other embodiments explicitly described and otherwise contemplated herein, and vice versa. Fairlead 156 is shown as it might appear in the process of being installed on a centerframe beam 155. Centerframe beam 155 can be part of a machine frame or structured for mounting upon a machine frame such as machine frame 12 discussed above. Fairlead 156 could also be installed on a different frame subcomponent, or directly to a main machine frame itself. In the illustrated embodiment, fairlead 156 includes a fairlead base 158 that includes a post 182. Post 182 can be integral with fairlead base 158 or attached to fairlead base 158 by bolting or welding, for example. Post 182 can include a plurality of bolting holes 184 formed therein, and is shown as it might appear being inserted into a complementarily shaped aperture 185 in centerframe beam 155. Lowering of fairlead 156 such that post 182 drops further into aperture 185 can align bolting holes 184 with bolting holes 186 formed in centerframe beam 155 itself. A plurality of bolts 188 are shown that can be installed through bolting holes 186 for threaded engagement in bolting holes 184. It will be recalled that bolting holes and bolts can be used to mount other embodiments. For instance, in the embodiment of FIG. 3 fairlead 56 is bolted by way of bolts 99 that are generally oriented vertically and thus parallel to a longitudinal axis of the fairlead when oriented at a raised fairlead position. Bolting holes 184, 186, and bolts 188 can be horizontally installed, in contrast. It should also be appreciated that other mounting strategies, including welding, could be employed within the present context. It is contemplated that fairleads might be welded in place in newly manufactured machines, and bolted when installed to existing machines already in the field. The present disclosure is not limited to any particular mounting strategy for a fairlead.

Fairlead boom 160 includes a first boom end 171 and a second boom end 173. A through-channel 175 extends between an inboard boom side 176 and an outboard boom side 177 at a location between first boom end 171 and second boom end 173. A pivot joint 180 pivotably couples fairlead boom 160 to fairlead base 158 and defines a fairlead pivot axis 164. A first feed pulley 161 defines a first feed pulley axis 165, and a second feed pulley 163 defines a second feed pulley axis 167. Each of first feed pulley 161 and second feed pulley 163 is mounted to fairlead boom 160 and positioned at least partially within through-channel 175. First feed pulley 161 and second feed pulley 163 are arranged so as to feed a hoisting cable 166, analogous to the other embodiments contemplated herein, passed in a serpentine path between first feed pulley 161 and second feed pulley 163 between a winch assembly and a sideboom in the associated ground-engaging machine. Fairlead boom 160 defines a fairlead longitudinal axis 169 extending between first boom end 171 and second boom end 173. Fairlead boom 160 includes a first side plate 179 and a second side plate 181 extending continuously between first boom end 171 and second boom end 173. Through-channel 175 is formed by first side plate 179 and second side plate 181, with each of first feed pulley 161 and second feed pulley 163 being supported between first side plate 179 and second side plate 181. In one implementation, fairlead 156 can have a bend or curvature of side plates 179 and 181 such that outboard boom side 177 has a concave profile adjacent to pivot joint 180, and a convex profile adjacent to second boom end 173.

INDUSTRIAL APPLICABILITY

Figure 4:
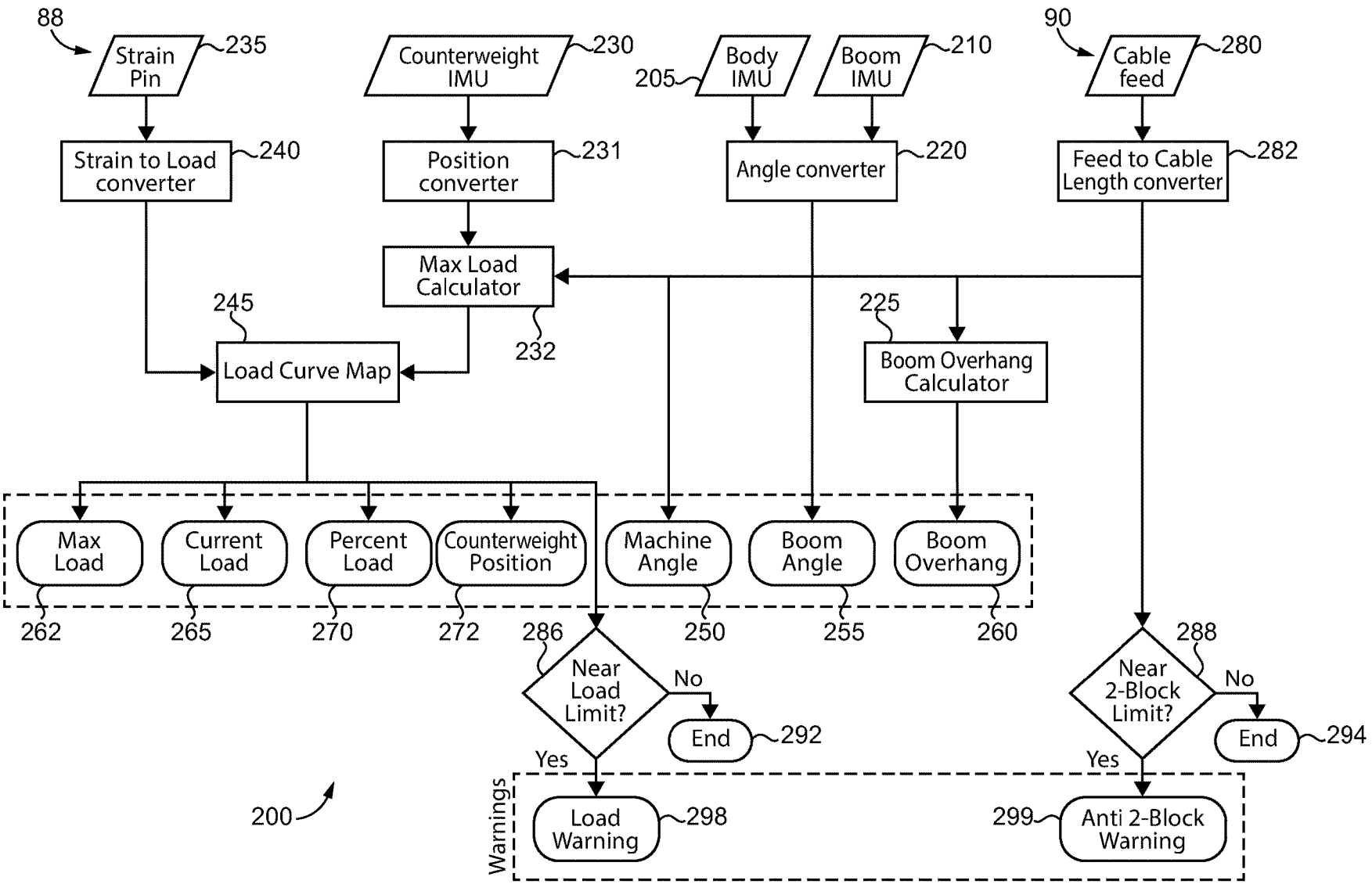
FIG. 4 is a flowchart illustrating example process and control logic flow, according to one embodiment.

Referring to the drawings generally, but in particular now to FIG. 4, there is shown a flowchart 200 illustrating example process and control logic flow corresponding to load monitoring program 88, and example process and control logic flow corresponding to cable feed program 90. It should be appreciated that programs 88 and 90 could be executed as subroutines of the same software program or could run as separate parallel routines. References in the following description to one of the embodiments herein should be understood to refer by way of analogy to any of the other embodiments contemplated herein. At a block 205 is shown the body IMU (frame sensor 98) that produces the frame monitoring signal, and at a block 210 is shown a fairlead boom IMU (fairlead sensor 72) that produces the fairlead monitoring signal. An angle converter is shown at a block 220 whereby electronic control unit 80 calculates an angle of sideboom 30 relative to a reference such as a horizontal reference plane. It will be recalled fairlead orientation is directly proportional to sideboom orientation. The specific proportional relationship will depend upon relative lengths and positioning of fairlead 56 and sideboom 30. At a block 225 a boom overhang calculator is shown, which can enable electronic control unit 80 to determine the relative extent to which, or the absolute extent to which, sideboom 30 extends outwardly of frame 12. At a block 230 is shown counterweight IMU, which can monitor a counterweight position to produce a monitoring signal by way of sensor 78, for example. At a block 231 a position converter converts a position signal indicative of counterweight position to a counterweight angle, for example. A max load calculator is shown at 232. At block 232, electronic control unit 80 can determine a max allowable load for a given orientation of fairlead 56, at a given orientation of machine 10/frame 12, and at a given orientation of counterweight 24. As further discussed below, electronic control unit 80 can output the overload alert based on a current hook load and the determined max allowable load from block 232.

It should also be appreciated that changing a sideboom angle, for instance, can change the max allowable load and justify outputting an overload alert. For example, an operator might lower sideboom 30 from a first orientation where a given hook load is allowable to a second orientation where the given hook load is not allowable. In such circumstances an overload alert can be output and the operator, or control system 70, could raise sideboom 30, raise counterweight 24, adjust both sideboom 30 and counterweight 24, or take some other action. Machine underfoot conditions could also be a factor in what max allowable loads or other threshold conditions are determined and how those conditions are managed. In view of the foregoing, it will thus be appreciated that load monitoring and management of overload and other machine operating conditions according to the present disclosure can be a dynamic process.

At a block 235 is shown the strain pin, producing the load monitoring signal by way of sensor 74. At a block 240 is depicted a strain to load converter where a strain detected by way of sensor 74 is converted to a load on hoisting cable 66. The determined load on hoisting cable 66 can be converted to a current hook load according to known trigonometric or other computational or inferential techniques, for example. A load curve map is shown at a block 245. At block 245 electronic control unit 80 can compare the max allowable load to a current hook load. The load curve map might include a current hook load coordinate and a max load coordinate. An alternative strategy could include a cable load coordinate, a fairlead boom angle coordinate, a max load coordinate, and/or a counterweight angle coordinate. Still other map configurations could be used.

Several of the blocks in control routine 88 represent information that can be displayed on display 94 to an operator. Machine angle is shown at a block 250 and can represent machine angle as determined on the basis of data from frame sensor 98. Boom angle is shown at a block 255 and can display to an operator an angle of sideboom 30 relative to a horizontal reference plane, or relative to some other reference such as frame 12. At a block 260, boom overhang is displayed. At a block 262, the max load determined at max load calculator 232 is displayed. At a block 265, the current hook load on hoisting cable 66 is displayed. Block 270 displays a percent load, meaning a percent of max allowable load that is currently applied to a hoisting cable 66. At a block 272 counterweight position is displayed.

At a block 280 of program 90 is shown cable feed or the cable feeding signal produced by cable feed sensor 76. At a block 282 is shown a feed-to-cable length converter where, for example, a number of pulley rotations is converted to a cable length. At a block 288, it is queried whether conditions are near the 2-block limit, based on determined locations of hook blocks 42 and 44 as described herein. If no, the control routine can end or exit at a block 294. If yes, the control routine can advance to a block 299 to output an anti-2-block warning or pulley collision alert. At a block 286 electronic control unit 80 can receive the load on hoisting cable 66 and query whether conditions are near a load limit? If no, the control routine can advance to a block 292 to end or exit. If yes, the control routine can advance to a block 298 to produce the load warning or overload alert.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fairlead for a hoisting system in a ground-engaging machine comprising:

a fairlead base for coupling to a frame of the ground-engaging machine;

a fairlead boom;

a pivot joint pivotably coupling the fairlead boom to the fairlead base;

a plurality of feed pulleys mounted to the fairlead boom for feeding a hoisting cable through the fairlead between a winch assembly and a sideboom in the ground-engaging machine;

instrumentation circuitry including a wiring harness structured for electrically connecting the instrumentation circuitry of the fairlead to hoisting control circuitry of the hoisting system included onboard the ground-engaging machine; and wherein the instrumentation circuitry further includes a sensor resident on the fairlead boom.

2. The fairlead of claim 1 wherein the sensor is structured to produce a fairlead monitoring signal indicative of an orientation of the fairlead relative to the frame of the ground-engaging machine.

3. The fairlead of claim 2 wherein the sensor includes an inertial measurement unit (IMU).

4. The fairlead of claim 2 wherein the instrumentation circuitry further includes a frame sensor resident on the fairlead base and structured to produce a frame monitoring signal indicative of an orientation of the frame of the ground-engaging machine relative to an underlying substrate.

5. The fairlead of claim 1 wherein the sensor includes a load sensor structured to produce a load signal indicative of a load on the hoisting cable.

6. The fairlead of claim 1 wherein the sensor includes a cable feed sensor structured to output a cable feeding signal indicative of a length of the hoisting cable fed through the fairlead.

7. The fairlead of claim 1 wherein the fairlead base includes a plurality of bolting holes formed therein for bolting the fairlead to the frame of the ground-engaging machine.

8. A fairlead for a hoisting system in a ground-engaging machine comprising:

a fairlead base for coupling to a frame of the ground-engaging machine;

a fairlead boom;

a pivot joint pivotably coupling the fairlead boom to the fairlead base;

a plurality of feed pulleys mounted to the fairlead boom for feeding a hoisting cable through the fairlead between a winch assembly and a sideboom in the ground-engaging machine;

instrumentation circuitry including a wiring harness structured for electrically connecting the instrumentation circuitry of the fairlead to hoisting control circuitry of the hoisting system included onboard the ground-engaging machine; and the instrumentation circuitry further including a sensor resident on the fairlead boom, wherein the sensor resident on the fairlead boom includes one or more of:

a first sensor structured to produce a fairlead monitoring signal indicative of an orientation of the fairlead relative to the frame of the ground-engaging machine, a load sensor structured to produce a load signal indicative of a load on the hoisting cable, and a cable feed sensor structured to output a cable feeding signal indicative of a length of the hoisting cable fed through the fairlead.

9. The fairlead of claim 8 wherein the instrumentation circuitry further includes a frame sensor resident on the fairlead base and structured to produce a frame monitoring signal indicative of an orientation of the frame of the ground-engaging machine relative to an underlying substrate.

10. The fairlead of claim 9 wherein the first sensor includes an inertial measurement unit (IMU).

11. The fairlead of claim 8 wherein the fairlead base includes a plurality of bolting holes formed therein for bolting the fairlead to the frame of the ground-engaging machine.

12. A fairlead for a hoisting system in a ground-engaging machine comprising:

a fairlead base for coupling to a frame of the ground-engaging machine;

a fairlead boom;

a pivot joint pivotably coupling the fairlead boom to the fairlead base;

a plurality of feed pulleys mounted to the fairlead boom for feeding a hoisting cable through the fairlead between a winch assembly and a sideboom in the ground-engaging machine;

instrumentation circuitry including a wiring harness structured for electrically connecting the instrumentation circuitry of the fairlead to hoisting control circuitry of the hoisting system included onboard the ground-engaging machine;

wherein the instrumentation circuitry further includes a first sensor resident on the fairlead boom and a frame sensor resident on the fairlead base, the frame sensor structured to produce a frame monitoring signal indicative of an orientation of the frame of the ground-engaging machine relative to an underlying substrate.

13. The fairlead of claim 12 wherein the instrumentation circuitry further includes a load sensor structured to produce a load signal indicative of a load on the hoisting cable.

14. The fairlead of claim 13 wherein the instrumentation circuitry further includes a cable feed sensor structured to output a cable feeding signal indicative of a length of the hoisting cable fed through the fairlead.

15. The fairlead of claim 14 wherein the first sensor includes an inertial measurement unit (IMU) and is structured to produce a fairlead monitoring signal indicative of an orientation of the fairlead relative to the frame of the ground-engaging machine.

* * * * *